US011350712B2

(12) United States Patent
Bojaxhi

(10) Patent No.: US 11,350,712 B2
(45) Date of Patent: Jun. 7, 2022

(54) SINGLE USE, MULTI-FUNCTIONAL GAUZE GROCERY BAG

(71) Applicant: Violeta Bojaxhi, Columbia, MD (US)

(72) Inventor: Violeta Bojaxhi, Columbia, MD (US)

( * ) Notice: Subject to any disclaimer, the term of this patent is extended or adjusted under 35 U.S.C. 154(b) by 0 days.

(21) Appl. No.: 17/301,053

(22) Filed: Mar. 23, 2021

(65) Prior Publication Data

US 2021/0204662 A1 Jul. 8, 2021

Related U.S. Application Data

(63) Continuation-in-part of application No. 16/720,770, filed on Dec. 19, 2019, now abandoned, which is a continuation-in-part of application No. 16/503,381, filed on Jul. 3, 2019, now abandoned.

(60) Provisional application No. 62/814,074, filed on Mar. 5, 2019.

(51) Int. Cl.

| | |
|---|---|
| ***A45C 3/04*** | (2006.01) |
| ***A45C 3/00*** | (2006.01) |
| ***B65D 33/10*** | (2006.01) |
| ***B65D 33/06*** | (2006.01) |
| ***B65D 33/14*** | (2006.01) |

(52) U.S. Cl.

CPC ..... *A45C 3/04* (2013.01); *A45C 3/001* (2013.01); *B65D 33/065* (2013.01); *B65D 33/105* (2013.01); *B65D 33/14* (2013.01)

(58) Field of Classification Search

CPC .. A45C 3/04; A45C 3/045; A45C 3/06; A45C 3/08; A45C 3/10; A45C 3/00; A45C 3/001

See application file for complete search history.

(56) References Cited

U.S. PATENT DOCUMENTS

| | | | | |
|---|---|---|---|---|
| 5,850,911 | A * | 12/1998 | Pakzad | B65D 31/12 206/217 |
| 6,193,034 | B1 * | 2/2001 | Fournier | A45C 7/0095 190/107 |
| 2003/0128897 | A1 * | 7/2003 | Lehrman | A45C 13/1046 383/2 |
| 2011/0026856 | A1 * | 2/2011 | Lopez-Araiza | B26F 1/44 383/10 |
| 2011/0026857 | A1 * | 2/2011 | Bautista | B65D 33/001 383/12 |

(Continued)

*Primary Examiner* — Derek J Battisti
(74) *Attorney, Agent, or Firm* — Dunlap Bennett & Ludwig, PLLC

(57) ABSTRACT

A cotton-based single use grocery bag for carrying groceries or other items. The single use grocery bag is also used for cleaning furniture, cleaning counter tops, washing dishes, etc. The single-use grocery bag may include the a body made of a cotton gauze material defining an internal compartment between a first side, a second side, a third side, a fourth side, a top, and a bottom, wherein the internal compartment is accessed through an opening at the top; the first side and the third side each comprise edges coupled together at a bottom portion of the body and separated at a top portion of the body; and the separated edges define a gap communicating the internal compartment with an outside of the body, wherein each gap is entirely disposed downward relative to the top and the opening and communicates the internal compartment to the external environment.

3 Claims, 6 Drawing Sheets

(56) References Cited

U.S. PATENT DOCUMENTS

| | | | | |
|---|---|---|---|---|
| 2011/0155794 | A1* | 6/2011 | Russell | B65D 29/00 229/68.2 |
| 2013/0156351 | A1* | 6/2013 | Kern | B65D 31/04 383/24 |
| 2014/0205210 | A1* | 7/2014 | Grossman | B65D 33/08 383/7 |
| 2020/0260843 | A1* | 8/2020 | Long | A45C 3/08 |

* cited by examiner

SINGLE USE, MULTI-FUNCTIONAL GAUZE GROCERY BAG

CROSS-REFERENCE TO RELATED APPLICATION

This is a continuation in part of U.S. non-provisional application Ser. No. 16/720,770, filed on Dec. 19, 2019, and of non-provisional application Ser. No. 16/503,381, filed on Jul. 3, 2019, as well as claims the benefit of priority of U.S. provisional application No. 62/814,074, filed Mar. 5, 2019, the contents of all of the above are herein incorporated by reference.

BACKGROUND OF THE INVENTION

The present invention relates to shopping bags and, more particularly, to a single use gauze grocery bag.

Shopping bags are used by shoppers to carry home their purchases. "Single use Plastic bags" are intended as mass production single-use disposable products; others are designed as reusable shopping bags.

Mass production refers to the production of a large scale for a low price usually by machinery. Plastic bags that are considered as mass production are now an omnipresent global product. Many countries are introducing legislation to ban plastic bags, because plastic never fully breaks down.

Reusable grocery bags that are present in today's market are thicker, heavier, and more expensive. Further, multiple uses can cause hygiene issues since they become dirty with time and are brought into food selling establishments, thus heightening the danger of spreading food-borne illness.

The average plastic bag picked up at the grocery store, or carry takeout in, has a lifespan of about 12 minutes but is made out of a material that lasts for a long period of time. When discarded, plastic bags clog sewage and storm drains, entangle and kill an estimated 100,000 marine mammals every year, and degenerate into toxic micro plastics that fester in our oceans and landfills for up to 1,000 years.

Despite this, shoppers collectively use around 500 billion single-use plastic bags every year, (100 billion/year in the US alone). That's 150 bags per person, per year, for every single person on Earth—or enough to circle the globe 4,200 times.

In 1997 the Great Pacific Garbage Patch was discovered, and this began to change how people viewed plastics. It was still another decade before San Francisco took that first stand against single-use plastic bags, but the effort has only gained momentum since then. Efforts to ban single-use plastic bags have spread across the world as people are beginning to understand that plastic is bad for the planet.

In the United States, there is a growing concern about the negative impact of single use plastic bags on human health and the environment. Several local and sub-national governments have implemented bans on the use of plastic bags as a result of this concern.

As can be seen, there is a need for a single use Echo-friendly biodegradable bag for grocery shopping that can be utilized in multiple other applications thereby solving at least some of the problems described above.

SUMMARY OF THE INVENTION

In one aspect of the present invention, a single-use grocery bag may include the following: a body made of a cotton gauze material; the body comprising an internal compartment defined in between a first side, a second side, a third side, a fourth side, a top, and a bottom, wherein the internal compartment is accessed through an opening at the top; the first side and the third side each comprise edges coupled together at a bottom portion of the body and separated at a top portion of the body; and the separated edges define a gap communicating the internal compartment with an outside of the body, wherein each gap is entirely disposed downward relative to the top and the opening, whereby an object could extend through the gap of the first side through the internal compartment and through the gap of the third side.

In another aspect of the present invention, the above-mentioned single-use grocery bag may include the following: wherein the cotton gauze material has a grade #10, #20, #30, or #40; and a first loop coupled to a top corner of the body and a second loop coupled to an opposing top corner of the body, wherein the top comprises a first edge and a second edge defining the opening therebetween, wherein the first edge and the second edge each comprise a plurality of openings; and a wax coating disposed on an outer surface of the body, wherein the wax coating is applied to a lower half of the body and the bottom of the body.

These and other features, aspects and advantages of the present invention will become better understood with reference to the following drawings, description and claims.

Figure 1:
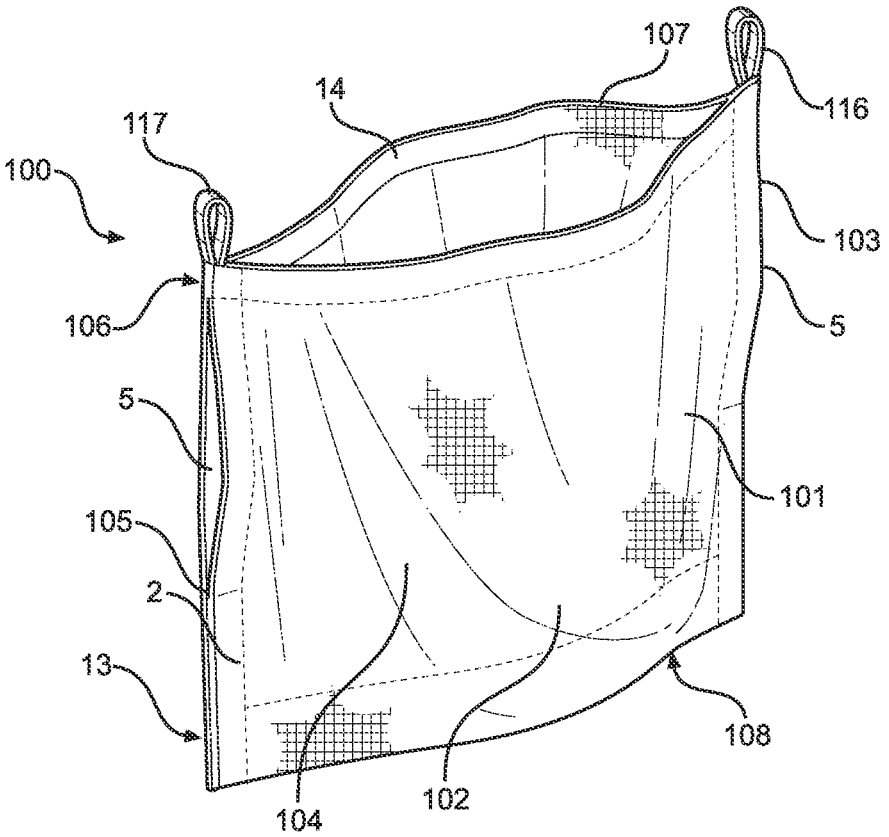
FIG. 1 is a perspective view of an embodiment of the present invention.

It should be noted that reference numeral #2 in the Figures is not stitching, but rather the edges of a fold that is folded onto itself, as the grocery bag is made of gauze and as such is semitransparent, translucent, etc., whereby that edge can be seen "through" the second and fourth sides (#104 and #106).

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a cotton based biodegradable bag that solves the problems caused by single-use plastic bags as mentioned above, as well as issues of hygiene that result from reusable grocery bags, and thereby effectively replacing the need for both products altogether. The present invention provides an effective design that turns an environmentally friendly gauze cheesecloth fabric into a sturdy single use grocery bag that can be used later as a cleaning cloth and a trash bag. The present invention may be made in mass production and further includes the following properties: the fabric is biodegradable, recyclable and disposable; light weight cotton fabric providing environmental benefits such as less water needed to grow the cotton in the field, less energy to manufacture it and less fuel required for its transportation and distribution; water absorption properties so it can be reused at home as a cleaning cloth, which replaces some of the needs currently filled by traditional paper-towels saving the user money and providing a beneficial effect on the environment by reducing reliance on trees for paper products, thus increasing its efficiency; inexpensive, thin, and light, with the ability to be waterproofed with wax coat treatment, which enables the bag to function as a trash holder; a design that allows for large scale and low cost mass production; a design that can easily fit onto existing traditional plastic grocery bag hooks allowing a quick and cost-effective transition in supermarkets from a single use plastic bag to a single use eco-friendly bag; a design that can easily unfastened to be adapted as a cleaning cloth at home after being used as a bag, due to the material being soft, thin and light the bag requires very little storage space, making it convenient to save on the kitchen drawer as a cleaning cloth when needed.

FIGS. 1, 4, 5, and 7, illustrate an exemplary grocery bag 100 for providing a sanitary use of a grocery bag and subsequent additional uses. The grocery bag 100 is useful for reducing the costs of cotton-based reusable grocery bags, the cost of the reusable bags is a leading reason for consumers declining using these reusable grocery bags. The grocery bag 100 is further useful in having additional uses once the initial use of carrying groceries or other items has occurred, these activities may include cleaning furniture, cleaning counter tops, washing dishes, etc.

The grocery bag 100 is preferably made of a natural, 100% cotton gauze material, but other materials are hereby contemplated including, but not limited to, 100% cotton absorbent medical bleached gauze, kitchen cotton cheese cloth, mutton cloth, etc. Cotton Gauze Cheesecloth fabric is available in at least seven different grades that vary from open to an extra-fine weave which are distinguished by the number of threads per inch in each direction. The grades can be #10, #40, #50, #60, #80 and #90. The lower the grade of gauze fabric uses less cotton to make the bag. This satisfies both the consumers' needs and leaves a smaller footprint on the environment. A bag made with cheesecloth grade #10-#50 weighs only about 0.3 to about 0.5 oz./bag and can carry up to about 10 pounds. A bag made with cheesecloth grade #60-#90 weighs about 0.6 to about 0.9 oz. and can carry up to about 20 pounds.

The grocery bag 100 has a body 101. The body 101 of the grocery bag 100 has an internal compartment 102, a first side 103, a second side 104, a third side 105, a fourth side 106, a top 107, and a bottom 108. The internal compartment 102 of the body 101 of the grocery bag 100 is useful for holding items 6 such as groceries, clothes, health and beauty aids, automotive supplies, etc. The internal compartment 102 of the body 101 of the grocery bag 100 is accessible by the top 107 of the body 101 of the grocery bag 100. The top 107 of the body 101 of the grocery bag 100 is an opening.

A first loop 117 is securely coupled to a top corner of the body 101. A second loop 116 is securely coupled to an opposing top corner of the body 101. The first loop 117 and the second loop 116 may be about two inches in length and may be sewn or glued on the top corners of the body 101. The first loop 117 and the second loop 116 provide a way to hang the grocery bags 100 onto the hooks of supermarkets check-out lanes. The first loop 117 and the second loop 116 may also be used to hang the grocery bag 100 from a support rod 7.

The bottom side 108 may include a fold 13 of about 2.5 inch upward. By folding the bottom side 108 in this manner, the bottom side 108 of bag 100 is doubled to 5 inches when filled with groceries. This simple design feature enables the bag 100 to carry objects more steadily and firmly while holding the shape of the bag well. The first side 103 and the third side 105 may also include a fold 2 that is folded about 1.2 inches onto itself. In certain embodiments, a gap may be formed through each of the top half of the first side 103 and the top half of the third side 105. The resulting opposing gaps 5 and their respective openings may be about 6 inches in length and are located on both sides of the grocery bag 100, directly below the bag opening. Each gap 5 may act as a handle for the grocery bag 100 and allow the user to carry the grocery bag 100 with a firm grip. Each gap 5 may act as an entry way into the internal compartment from each of the two sides of the bag 100.

Figure 10:
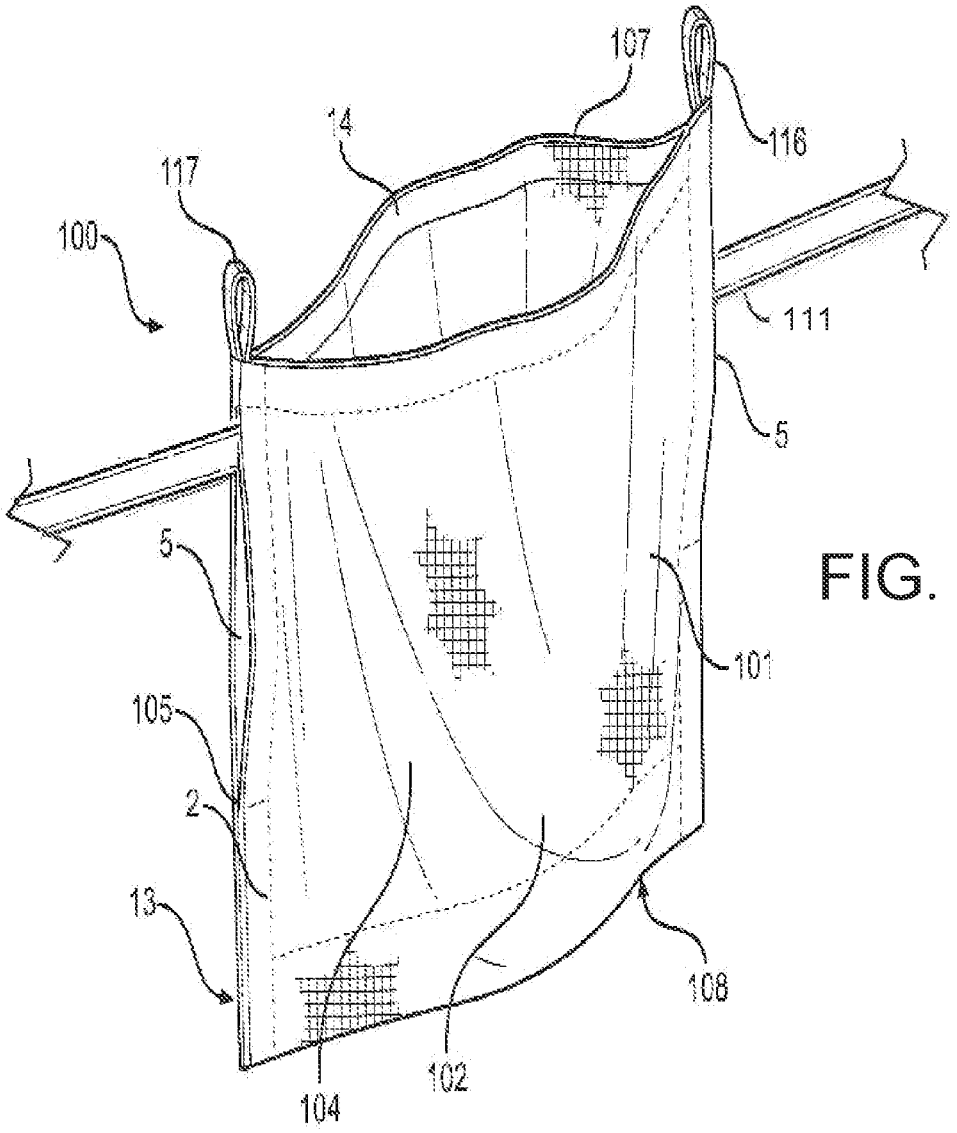
FIG. 10 is a perspective view of an embodiment of the present invention, illustrating that an elongated member 111 extending through the two opposing side gaps 5.

Referring to FIG. 10, two opposing gaps 5 may be aligned so that an elongated member 111 can extend continuously from the external environment and through the gap 5 of the top half of the first side 103, through the internal compartment, and through the gap of the top half of the third side 105 to external environment. The first side and the third side each may include edges coupled together at a bottom portion of the body and separated at a top portion of the body. These separated edges may define each gap 5 and their associated openings.

Each gap 5 may be deemed to have an external opening communicating to the external environment outside of the bag 100, and an opposing internal opening communicating with the internal compartment. Each gap 5 may be entirely disposed downward relative to the top and the top opening, whereby an object/elongated member 111 could extend through the gap of the first side into and (if desired) through the internal compartment and through the gap of the third side.

In certain embodiments, the elongated member 111 could be a user's arm, thereby the opposing gaps 5 can act as another set of aligned handles, as well as facilities the inventions use as cleaning tool (when not carrying groceries). These gaps 5 also are important for accessing the internal compartment and the goods therein though the sides of the bag 100; thus, a user may be carrying the grocery bag 100 by way of the first handle 122 and a second handle 124, yet still be able to access the internal compartment without letting go of the first handle 122 and a second handle 124.

Additionally, the gaps 5 can be used to hang the bag 100 directly on existing bag hooks at the supermarket check-out lines. Thus, the elongated member 11 may be these check-out line hooks.

The grocery bag 100 may include a self-finished edge 14. The self-finished edge 14 is incorporated at the opening of the grocery bag 100. The self-finished edge 14 prevents the fabric from fraying when wet and used as a cleaning cloth. The term "self-finished" (also known as "selvage") means that the edge does not require additional finishing to prevent fraying edges thus the cost of production is immediately reduced making product easier for mass production.

Figure 2:
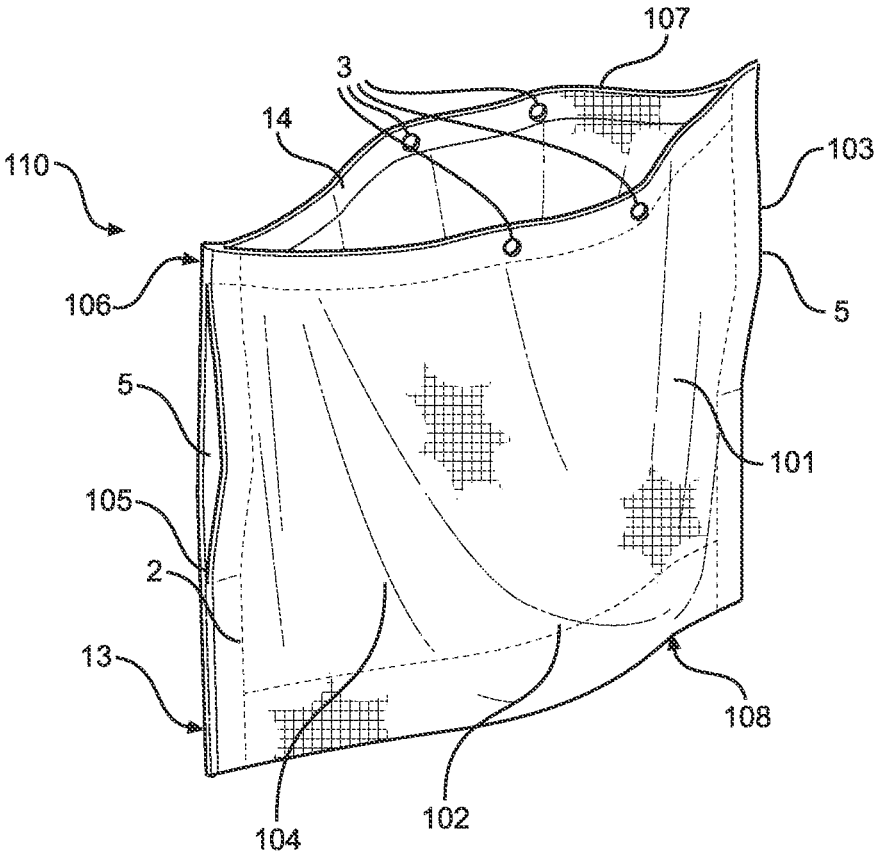
FIG. 2 is a perspective view of an embodiment of the present invention.

FIG. 2 illustrates a grocery bag 110 that has the body 101. The body 101 of the grocery bag 110 has an internal compartment 102, a first side 103, a second side 104, a third side 105, a fourth side 106, a top 107, and a bottom 108. The internal compartment 102 of the body 101 of the grocery bag 110 is useful for holding items such as groceries, clothes, health and beauty aids, automotive supplies, etc. The internal compartment 102 of the body 101 of the grocery bag 110 is accessible by the top 107 of the body 101 of the grocery bag 110. The top 107 of the body 101 of the grocery bag 110 is an opening.

The bottom side 108 may include a fold 13 of about 2.5 inch upward. By folding the bottom side 108 in this manner, the bottom side 108 of bag 110 is doubled to 5 inches when filled with groceries. This simple design feature enables the bag 110 to carry objects more steadily and firmly while holding the shape of the bag well. The first side 103 and the third side 105 may also include a fold 2 that is folded about 1.2 inches onto itself. In certain embodiments, a gap 5 may be formed through the top half of the first side 103 and the top half of the third side 105. The gaps 5 may be about 6 inches in length and are located on both sides of the grocery bag 110, directly below the bag opening. The gap 5 may act as a handle for the grocery bag 110 and allow the user to carry the grocery bag 110 with a firm grip.

The grocery bag 110 may include a self-finished edge 14. The self-finished edge 14 is incorporated at the opening of the bag. The self-finished edge 14 prevents the fabric from fraying when wet and used as a cleaning cloth. The term "self-finished" (also known as "selvage") means that the edge does not require additional finishing to prevent fraying edges thus the cost of production is immediately reduced making product easier for mass production.

Two small pre-cut holes 3 at around 1 inch in diameter and around 6 inches away from each other are located on each top lip of the top side 107 of the grocery bag 110. A fray stop spray may be applied to the holes 3 to prevent the holes 3 from fraying. The holes 3 allow the grocery bag 110 to hang onto the hooks of supermarket check-outlines.

Figure 6:
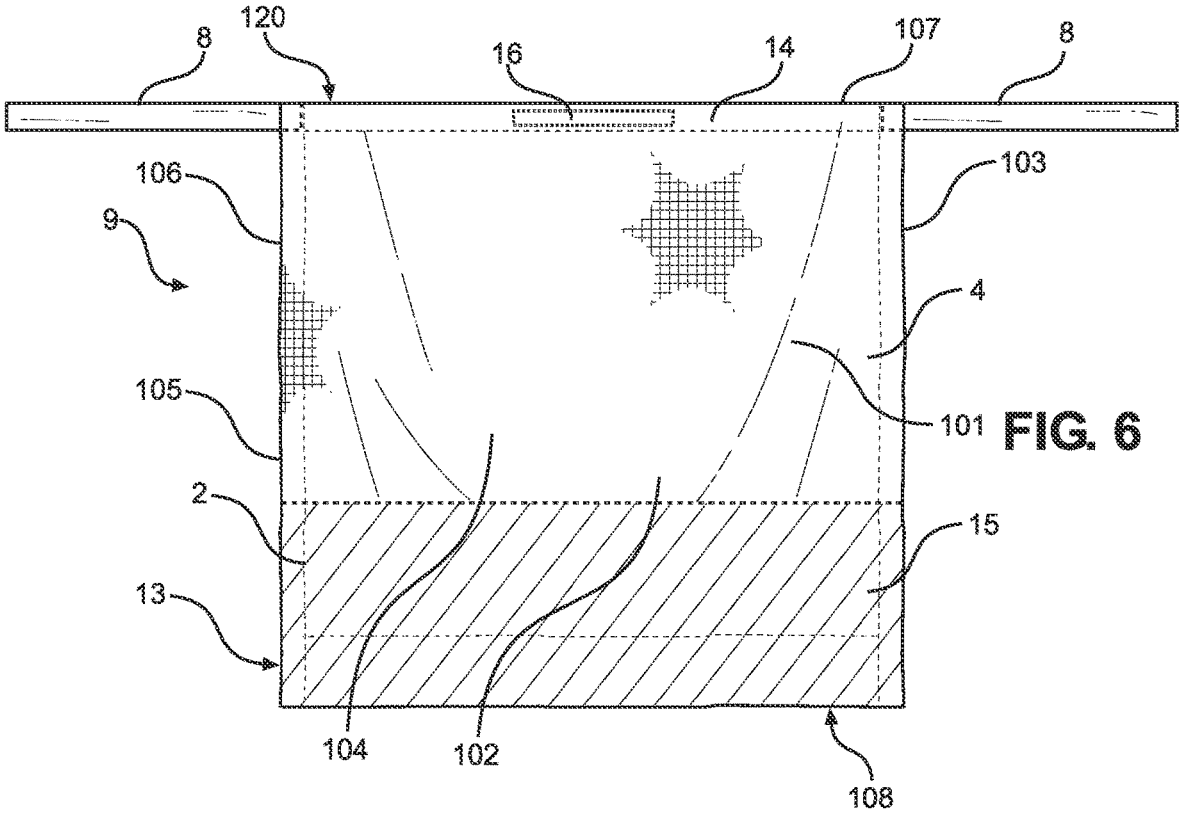
FIG. 6 is a front view of an embodiment of the present invention.
Figure 7:
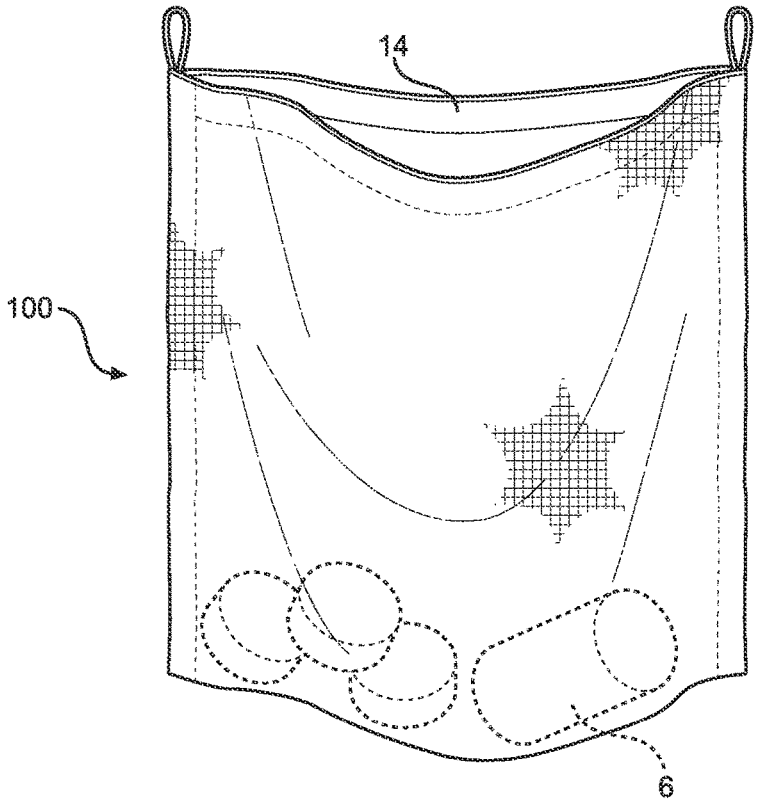
FIG. 7 is a front view of an embodiment of the present invention, shown in use.

FIG. 6 illustrates a grocery bag 120 that has a body 101. The body 101 of the grocery bag 120 has an internal compartment 102, a first side 103, a second side 104, a third side 105, a fourth side 106, a top 107, and a bottom 108. The internal compartment 102 of the body 101 of the grocery bag 120 is useful for holding items such as groceries, clothes, health and beauty aids, automotive supplies, etc. The internal compartment 102 of the body 101 of the grocery bag 120 is accessible by the top 107 of the body 101 of the grocery bag 120. The top 107 of the body 101 of the grocery bag 120 is an opening.

The bottom side 108 may include a fold 13 of about 2.5 inch upward. By folding the bottom side 108 in this manner, the bottom side 108 of bag 120 is doubled to 5 inches when filled with groceries. This simple design feature enables the bag 120 to carry objects more steadily and firmly while holding the shape of the bag well. The first side 103 and the third side 105 may also include a fold 2 that is folded about 1.2 inches onto itself. A cut-out handle 16 may also be formed on the top 107. The cut-out handle 16 may be removed and the remaining opening may be used as a handle.

The present invention may also be used as a trash bag. In such embodiments, the present invention may include a wax layer 15 applied to an outer surface of the grocery bag 120. In order for the grocery bag 120 to be cost effective, the wax layer 15 may be applied to the bottom section of the grocery bag 120 up until around 10 inches from bottom, i.e. where the liquids tend to gather. In such embodiments, the present invention may further include strings 8 extending from opposing top corners of the grocery bag 120, allowing the grocery bag to be tied off and thereby function as trash bag. The strings 8 may be about 5-inches long and allow users to tie the top of the trash bag together once trash is ready to be disposed of.

Figure 8:
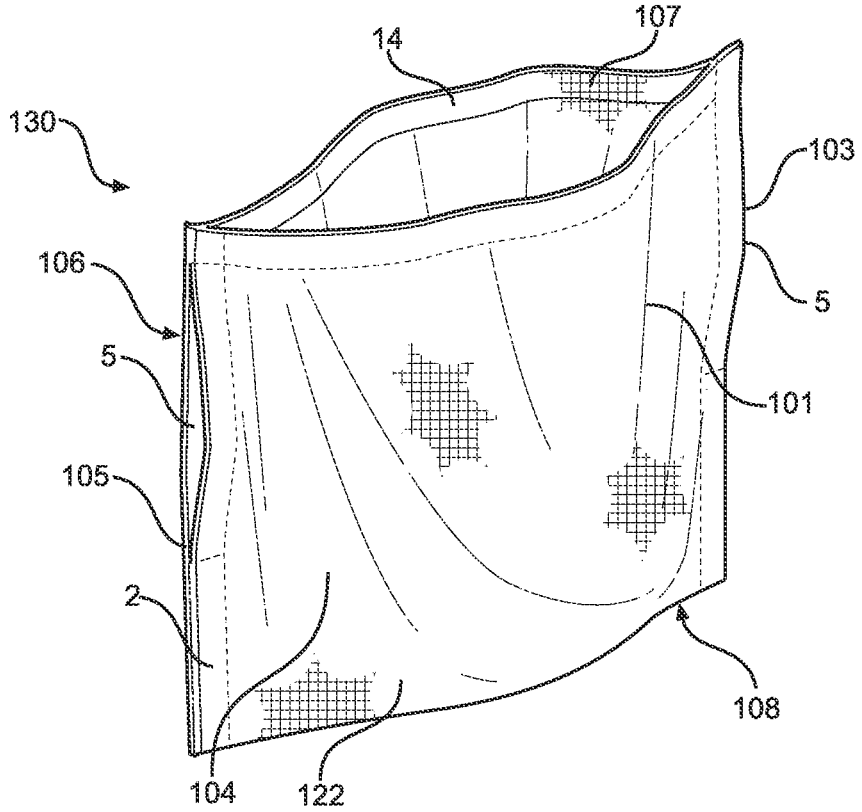
FIG. 8 is a perspective view of an embodiment of the present invention.

FIG. 8 illustrates a basic grocery bag 130 that has a body 101. The body 101 of the grocery bag 130 has an internal compartment 102, a first side 103, a second side 104, a third side 105, a fourth side 106, a top 107, and a bottom 108. The internal compartment 102 of the body 101 of the grocery bag 130 is useful for holding items such as groceries, clothes, health and beauty aids, automotive supplies, etc. The internal compartment 102 of the body 101 of the grocery bag 130 is accessible by the top 107 of the body 101 of the grocery bag 130. The top 107 of the body 101 of the grocery bag 130 is an opening.

The first side 103 and the third side 105 may also include a fold 2 that is folded about 1.2 inches onto itself. In certain embodiments, a gap 5 may be formed through the top half of the first side 103 and the top half of the third side 105. The gaps 5 may be about 6 inches in length and are located on both sides of the grocery bag 130, directly below the bag opening. The gap 5 may act as a another thicker/sturdier/more durable handle for the grocery bag 130 and allow the user to carry the grocery bag 130 with a firm grip but may also be used to hang the grocery bag 130 on the hooks of supermarket check-out lanes.

Figure 9:
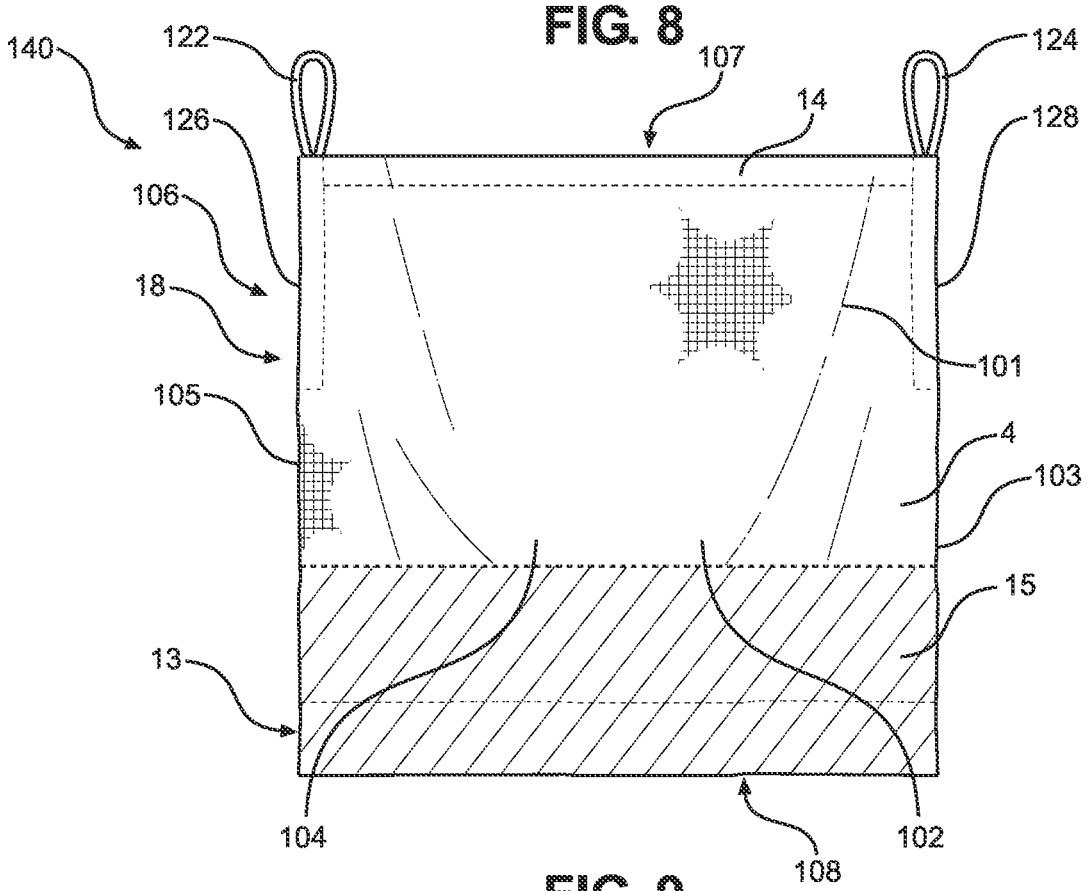
FIG. 9 is a front view of an embodiment of the present invention.

Referring to FIG. 9, the grocery bag 140 has a body 101. The body 101 of the grocery bag 140 has an internal compartment 102, a first side 103, a second side 104, a third side 105, a fourth side 106, a top 107, and a bottom 108. The internal compartment 102 of the body 101 of the grocery bag 140 is useful for holding items 6 such as groceries, clothes, health and beauty aids, automotive supplies, etc. The internal compartment 102 of the body 101 of the grocery bag 140 is accessible by the top 107 of the body 101 of the grocery bag 140. The top 107 of the body 101 of the grocery bag 140 is an opening.

The grocery bag 140 may be made of a tubular gauze fabric. While the previous alternative has both sides of the bag sewn and a gap creates handles, for this embodiment only the bottom 108 is sewn. Additionally, a first handle 122 and a second handle 124 of about 5 inches are sewn or glued at opposing top corners of the bag 140. When the tubular gauze fabric is cut as result the top 107 of the bag 140 has no self-finished edges and in order to prevent the fabric from fraying, the fray stop spray may be applied to the top section. After The bottom 108 has been sewn to create the bag a fold 13 of 2.5 inch upward may be incorporated. By folding the bottom in this manner, the bottom 108 of bag 140 is doubled automatically to about 5 inches when filled with groceries. This simple design feature enables the bag 140 to carry objects more steadily and firmly while holding the shape of the bag 140.

The present invention may also be used as a trash bag. In such embodiments, the present invention may include a wax layer 15 applied to an outer surface of the grocery bag 140. In order for the grocery bag 140 to be cost effective, the wax layer 15 may be applied to the bottom section of the grocery bag 140 up until around 10 inches from bottom, i.e., where the liquids tend to gather. The first handle 122 and the second handle 124 may act as draw strings on both top corners of the bag 140 which serve to tie the top of the trash bag together once trash is ready to be disposed of.

The gauze fabric used for the present invention may include any of the following: 100% cotton absorbent medical (bleached and sterilized) gauze, used for medical purposes to cover or wrap wounds due to its ability to allow wounds to "breathe" while rapidly absorbing fluids; 100% pure natural cotton cheesecloth (bleached) is used in the cheesemaking industry to remove whey from cheese curd and helps to hold the curd together while the cheese is formed; and 100% kitchen cotton cheesecloth (bleached or unbleached, used for all purpose cleaning such as dish washing, automobiles, and any other type of household surfaces.

In certain embodiments, a lower grade of gauze fabric may be used with the present invention. Lower grade cheesecloth fabric is thin, lightweight and has tiny holes which allow air and water to flow thus providing for high water-absorption and sanitary properties which enables the present invention to efficiently function as a household cleaning cloth.

A method of making the present invention may include the following. The present invention includes a cost-effective mass production advantage. Due to its uniquely simple design, the gauze roll may be cut and developed into a bag by automated industrial machines in the exact location where the fabric itself is also manufactured. This major advantage serves to eliminate shipping and transportation costs. The process of developing the bag may be achieved using the following steps: a gauze cheesecloth roll (preferably treated with starch), with a standard width of 1 yard (or 100 cm), and self-finished edges on both sides may be cut into 20 inches pieces; the insides of the 1 yard fabric that has loose fray edges are folded into 1.2 inches in order to prevent the edges from unraveling; fold the fabric to create the shape of the "bag" around 20 inches×20 inches; perform the automatic sewing or gluing of both sides of the bag from top to bottom by leaving a 6 inch gap on the top corners, and continue sewing or gluing to the bottom; before finished sewing, fold the bottom of the bag 2.5 inches upward. By folding the bottom in this manner, the bottom of bag will be doubled of 5 inches automatically when filled with groceries, thus enables the bag to carry objects more steadily and firmly while holding the shape of the bag well.

Figure 3:
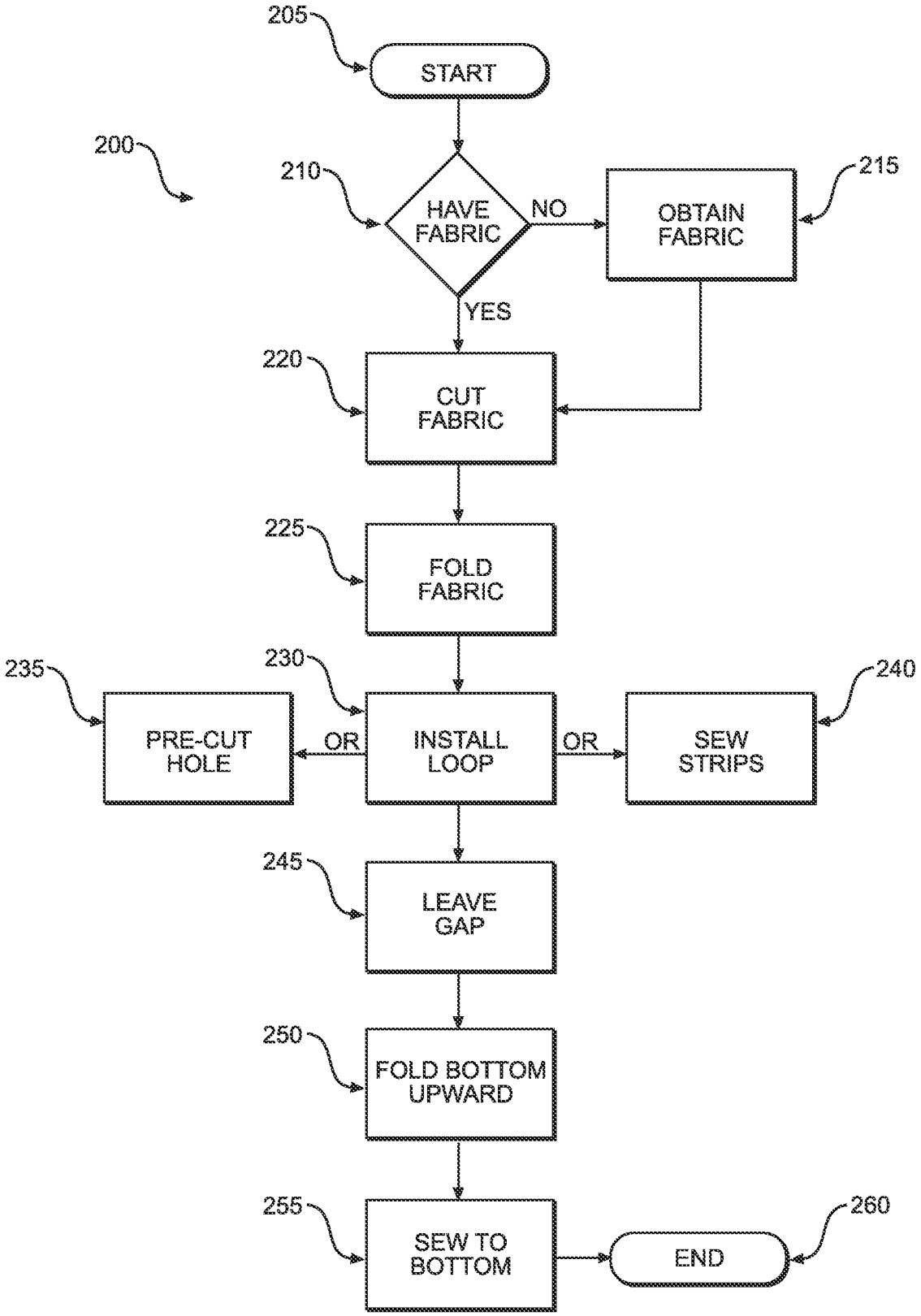
FIG. 3 is a flowchart diagram of an embodiment of the present invention.
Figure 4:
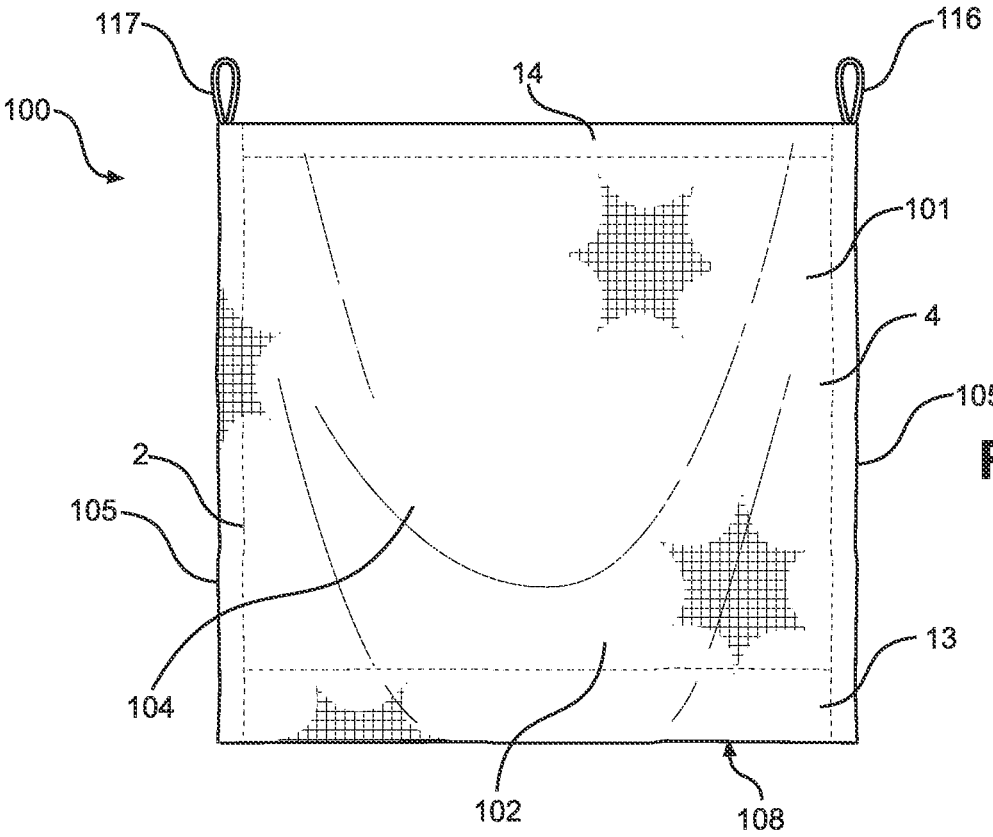
FIG. 4 is a front view of an embodiment of the present invention.
Figure 5:
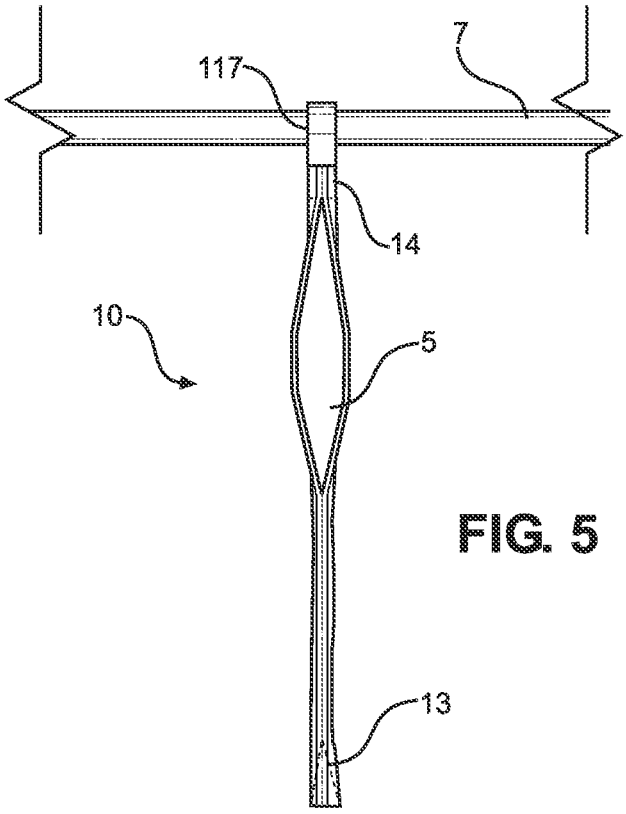
FIG. 5 is a side view of an embodiment of the present invention.

Moving now to FIG. 3, a flowchart 200 illustrates the creation of the grocery bag.

At 205, the process starts. At 210 it is determined if there is enough fabric or any fabric available to make the grocery bag 100. If at 215 if it is determined that there is not enough fabric or no fabric, then the consumer obtains enough fabric to produce the grocery bag 100. The fabric is preferably a natural, 100% cotton gauze material, but other materials are hereby contemplated including, but not limited to, 100% cotton absorbent medical bleached gauze, kitchen cotton cheese cloth, mutton cloth, etc.

After it has been determined at 210 that enough fabric is available or the fabric has been obtained at 215, then at 220 the fabric is cut to a fifty centimeter by one hundred-centimeter (50 cm×100 cm) dimension. The fabric utilized for the opening at the top 107 of the grocery bag preferably has self-finishing edges which prevent the edges from fraying when cut (also known as "selvage"). Further, the self-finishing edges reduce costs of production of the grocery bag.

At 225, the cut fabric is folded to create a fifty-centimeter by fifty-centimeter (50 cm×50 cm) bag. Each side of the bag is then folded one and two tenths (1.2) inches on an inside.

At 230, the loop is placed between each folded top corner and the corner is sewn to securely coupled the loops to the bag. Alternatively, the holes are cut or the strips are sewn to the bag.

At 245, a gap of 6 inches left and sewn straight towards the bottom of the bag. Prior to sewing the bottom of the bag, fold the bottom of the bag two and one-half (2.5) inches upward and then continue, at 240, sewing to the bottom of the bag. By folding the bottom in this manner, the bottom of bag is doubled to 5 inches when filled with groceries, thus enabling the bag to carry objects more steadily and firmly while holding the shape of the bag well.

Once the sewing of the bottom of the bag has been completed at 240, the bag has been made and then at 245 the process for creating the grocery bag has ended and thus the grocery bag can be used.

It should be understood, of course, that the foregoing relates to exemplary embodiments of the invention and that modifications may be made without departing from the spirit and scope of the invention as set forth in the following claims.

What is claimed is:

1. A grocery bag and cleaning cloth combination, wherein said grocery bag is supportable by an elongated member engaging a selvage, wherein said cleaning cloth has a leading edge defined by the selvage, comprising: a body made of a cotton gauze; the body comprising an internal compartment defined in between a first side, a second side, a third side, a fourth side, the selvage, and a bottom edge, wherein the internal compartment is accessed through an opening, wherein the opening is defined by an upper portion of the selvage, and wherein the opening is circumscribed by the selvage; a plurality of vertically-oriented holes formed in the selvage, wherein each vertically-oriented hole has a diameter of one inch, wherein the selvage extends from the opening toward the bottom edge by a vertical distance sufficient to circumscribe the diameter of each vertically-oriented holes; the first side and the third side each comprise edges coupled together at a bottom portion of the body and separated at a top portion of the body, wherein said side edges each include a side fold over an inch in width; the separated edges define at least five-inch gap communicating the internal compartment with an outside of the body, wherein each gap does not extend along the second and fourth sides, and wherein an uppermost point of each gap is defined by a lower edge of the selvage; the elongated member extends through the gap of the first side, through the internal compartment, and through the gap of the third side; the bottom edge includes a bottom fold having a width over two inches, whereby when the body is used as the cleaning cloth, the side folds, the bottom fold, and the selvage prevent fraying of a periphery of the body; and a first loop coupled to a top corner of the body and a second loop coupled to an opposing top corner of the body.

2. The grocery bag and cleaning cloth combination of claim 1, wherein the cotton gauze has a grade #10, #20, #30, or #40.

3. The grocery bag and cleaning cloth combination of claim 2, wherein a wax coating on an outer surface portion of the body, wherein said outer portion is vertically below the gaps.

* * * * *